US008320427B2

(12) United States Patent
Carter et al.

(10) Patent No.: US 8,320,427 B2
(45) Date of Patent: Nov. 27, 2012

(54) COLD WALLED INDUCTION GUIDE TUBE

(75) Inventors: William T. Carter, Galway, NY (US); Russell S. Miller, Ballston Spa, NY (US); Howard R. Hart, Jr., Schenectady, NY (US)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 12/639,553

(22) Filed: Dec. 16, 2009

(65) Prior Publication Data

US 2011/0139394 A1 Jun. 16, 2011

(51) Int. Cl.
*F27D 3/00* (2006.01)
*H05B 6/02* (2006.01)
*H05B 6/22* (2006.01)

(52) U.S. Cl. ..... 373/142; 373/138; 373/156

(58) Field of Classification Search ..... 373/42, 373/44, 45, 142, 156, 144, 151; 164/507, 164/509, 493, 471, 513; 222/167, 598, 593; 75/10.16, 10.24; 266/237; 219/236
See application file for complete search history.

(56) References Cited

U.S. PATENT DOCUMENTS 5,160,532 A 11/1992 Benz et al.
5,479,438 A * 12/1995 Blum et al. ..... 373/156
5,649,992 A 7/1997 Carter, Jr. et al.
5,769,151 A 6/1998 Carter, Jr. et al.
5,809,057 A 9/1998 Benz et al.
5,992,503 A 11/1999 Knudsen et al.
6,097,750 A 8/2000 Knudsen et al.
6,104,742 A 8/2000 Carter, Jr. et al.
6,196,427 B1 3/2001 Carter, Jr. et al.
6,214,286 B1 * 4/2001 Larsen et al. ..... 266/241
6,250,522 B1 6/2001 Carter, Jr. et al.
6,289,258 B1 9/2001 Carter, Jr. et al.
6,631,753 B1 * 10/2003 Carter et al. ..... 164/46
2003/0209535 A1 * 11/2003 Haimer et al. ..... 219/600
2007/0057416 A1 * 3/2007 Kennedy ..... 266/202
2009/0046825 A1 * 2/2009 Dulka et al. ..... 376/305

FOREIGN PATENT DOCUMENTS

EP 0899052 A1 3/1999

* cited by examiner

*Primary Examiner* — Henry Yuen
*Assistant Examiner* — Hung D Nguyen
(74) *Attorney, Agent, or Firm* — Ernest G. Cusick; Frank A. Landgraff

(57) ABSTRACT

The introduction of spray formed metals into critical applications in the aircraft engine and power generation industries has been hampered by the possibility of erosion of oxide particles from a crucible lining or pouring nozzle in conventional spray forming equipment. These oxide particles may become inclusions that limit low-cycle fatigue life of parts. Use of a cold-walled induction guide (CIG) with an electrical insulation layer between copper CIG elements and the liquid metal offers a means of delivering ceramic-free alloys to a spray system with improved efficiency. CIG design options facilitated by a new oven-brazed fabrication technique resolve induction coil environmental isolation issues, correct thermal strain tolerance problems, facilitate dual frequency induction designs, allow improved electrical coupling efficiency and thermal efficiency, result in improved melt flow initiation, and facilitate disassembly without damage from the solidified melt.

11 Claims, 6 Drawing Sheets

COLD WALLED INDUCTION GUIDE TUBE

STATEMENT REGARDING FEDERALLY SPONSORED RESEARCH & DEVELOPMENT

This invention was made with Government support under contract number 70NANB1H3042 awarded by National Institute of Standards and Technology. The Government has certain rights in the invention.

CROSS REFERENCE TO RELATED APPLICATIONS

The present invention is related to the following application: Ser. No. 12/639,521, assigned to General Electric and filed on Dec. 16, 2009.

BACKGROUND OF THE INVENTION

This invention relates generally to control of the flow of refined metal in an ESR-CIG apparatus and more specifically to a CIG apparatus providing a more efficient and controlled flow of liquid refined metal. The ESR apparatus is an electroslag refining apparatus and the CIG is a cold walled induction guide apparatus. More particularly the invention relates to controlling the flow of liquid metal as a liquid metal stream to, through and from a CIG. Such liquid metal flow may be used in conjunction with nucleated casting for large metal ingots used in articles of manufacture, such as turbine wheels.

Electroslag refining (ESR) is a process used to melt and reline a wide range of alloys for removing various impurities therefrom. Typical alloys, which may be effectively refined using electroslag refining, include those based on nickel, cobalt, or iron. The initial, unrefined alloys are typically provided in the form of an ingot which has various defects or impurities which are desired to be removed during the refining process to enhance metallurgical properties, including oxide cleanliness, grain size and microstructure, for example.

In a conventional electroslag apparatus, the ingot is connected to a power supply and defines an electrode, which is suitably suspended in a water-cooled crucible containing a suitable slag corresponding with the specific alloy being refined. The slag is heated by passing an electrical current from the electrode through the slag into the crucible and is maintained at a suitable high temperature for melting the lower end of the ingot electrode. As the electrode melts, a refining action takes place with oxide inclusion in the ingot melt being exposed to the liquid slag and dissolved therein. Droplets of the ingot melt fall through the slag by gravity and are collected in a liquid melt pool at the bottom of the crucible.

The refined melt may be extracted from the crucible by a conventional induction-heated, segmented cold-walled induction heated guide (CIG). The refined melt extracted from the crucible in this matter provides an ideal liquid metal source for various solidification processes including spray deposition.

The electroslag apparatus may be conventionally cooled to form a solid slag skull on the surface for bounding the liquid slag and preventing damage to the crucible itself as well as preventing contamination of the ingot melt from contact with the patent material of the crucible. The bottom of the crucible typically includes a water-cooled, copper cold hearth against which a solid skull of the refined melt forms for maintaining the purity of the collected melt at the bottom of the crucible. The CIG discharge guide tube or downspout below the hearth is also typically made of copper and is segmented and water-cooled for also allowing the formation of a solid skull of the refined melt for maintaining the purity of the melt as it is extracted from the crucible.

The cold hearth and the guide tube of the conventional electroslag refining apparatus are relatively complex in structure, and are therefore expensive to manufacture. The guide tube typically joins the cold hearth in a conical funnel with the induction heating coils surrounding the outer surface of the funnel and the downspout through which the liquid metal flows.

A plurality of water-cooled induction heating electrical conduits surround the guide tube for inductively heating the melt for controlling the discharge flow rate of the melt through the tube. Alternating currents in the induction heating electrical conduits surrounding the copper funnel segments induce alternating eddy currents within the copper segments. In turn the alternating eddy currents within the copper funnel segments of the guide tube induce currents within the liquid metal in the flow path through the guide tube.

FIG. 1 illustrates a system 5 for nucleated casting of liquid metals. The system includes a refining system 10, a pouring system 60, and a spraying system 80, which are described below. FIG. 1 illustrates the refining system 10 for refining alloy metals in an electroslag refining furnace. Referring to FIG. 1, at the top is the melting system, which is essentially a short electroslag refining furnace 15. A consumable electrode 20 is fed into the electroslag refining furnace 15 from above using a drive mechanism (not shown). The bottom face 25 of the consumable electrode 20 is immersed into a hot liquid slag 35, which heats the bottom face 25 of the electrode 20 causing it to melt. Metal droplets are formed on the face of the electrode and fall through the slag 35 to form a liquid metal pool 40 below the slag 35. Any oxide inclusions that are present in the electrode 20 will be exposed to the slag and will be dissolved. The slag 35 is kept hot with alternating electric current 46 from the consumable electrode power supply 45, generally at low voltages and conventional frequencies, that is fed into the slag through the consumable electrode 20. The required voltage is measured as a signal that is used to control the rate of advance of the consumable electrode 20 as the bottom face 25 is melted. An unconsumable electrode 50 is also shown, being an upper portion of the ESR crucible 55. Then electric current 47 may be fed from power supply 70 into the unconsumable electrode 50 instead of, or in addition to the current supplied to the consumable electrode 20.

A pouring system 60 provides for bottom pouring from the ESR furnace 15 to form the liquid metal stream 30. To avoid contaminating the liquid metal stream 30 with oxide inclusions that may erode from a ceramic nozzle, a CIG 65 with a ceramic-free induction-heated copper funnel 61 is used to form the liquid metal stream 30.

The copper funnel 61 may be segmented radially and surrounded by one or more induction coils 66, 67. The electric current is oscillated in the induction coils 66, 67, inducing a current in each of the copper segments, and subsequently inducing a heating current in the flowing liquid metal stream 30. Heat that is induced in the copper components is removed with cooling water flow 63.

In some such conventional CIG systems, the power may be delivered to each of the induction coils at different frequencies. The amount of power delivered to each of the induction coils and the cooling water to cool the copper funnel 61 may be controlled to start and stop the flow of liquid metal in the nozzle, the amount of superheat supplied, and the volumetric rate of flow.

A CIG 90 with conventional copper funnel 91 such as from U.S. Pat. No. 5,160,532 by Benz et al. is illustrated in cutaway FIG. 2. The funnel 91 is composed of multiple copper segments 92 that are radially distributed around a central axis 93. Induction coils 94 are mounted on the underside of the funnel 91. The copper segments 92, known as copper fingers, are mechanically supported at an outer radial end by baseplate 95 or other structures of the CIG 90. Cooling water may be provided to the CIG through channels 96 providing supply and return ducts 97 to the individual copper segments 92. Separate layers of electrical insulation 98 have been applied between copper segments 92. Utilization of large numbers of copper segments, however, have resulted in structurally inadequate finger structures in contact with the liquid metal flow, thereby causing mechanical stability issues and lack of control related to varying of the hole size for the liquid metal flow. Experimentation with CIGs using such segmented copper funnels has shown the device to produce undesirably low efficiency.

An insulator is a material or object that prevents the flow of electrical charges, thereby preventing the flow of an electric current. While an electrical insulating material must be capable of withstanding the voltage and frequency of the power source which they are intended to insulate, the material must also be suitable for environment in which is to operate. These environmental factors include temperature, mechanical wear, and chemical composition of the surroundings. Further, while maintaining the appropriate electrical insulating protection characteristics, the insulating material must also not adversely impact other materials or components to which it comes in contact or to which it is exposed. Exposure to harsh environments requires insulating materials that can withstand the environment. Such a harsh environment is encountered in metal refining processes.

No electrical insulation has been employed between the copper segments and the liquid metal pool (not shown) within the funnel 92, owing to the harsh environment. Conventional electrical insulators cannot withstand the harsh environment of this application. Other unconventional insulation, such as plasma sprayed alumina, is thick and friable. Such insulators crack or crumble when in contact with the refined flow of the liquid metal and therefore are unacceptable for use because they introduce the insulating material as an impurity into the refined metal.

However, unless the copper segments of the guide tube are electrically insulated from the liquid metal, some of the induced currents within the copper segments of the guide tube will flow into the liquid metal, thereby reducing the transfer of energy through induction into the liquid metal. Therefore, it is desirable to electrically insulate the copper segments of the guide tube from the liquid metal flowing through the guide tube. The insulating layer on the copper segments must sustain high thermal gradients and thermal shock imposed during the heating and cooling of the liquid metal. The insulating layer must be robust, but at the same time thin so as not to interfere with the liquid metal flow taking place in a specially shaped flow path of the funnel.

Again referring to FIG. 1, an atomization and collection system 80 is also part of such a casting system. After a short free-fall from the CIG 90, the liquid metal stream 30 is atomized using a conventional open atomizer 81. The atomizer 81 directs a gas jet onto the liquid metal stream 30 and converts it into a spray 83, accelerating the spray droplets from the atomization zone toward a collection mold 85, cooling them in flight.

Other collection systems may be employed including, but not limited to, metal powder atomizing, melt spinning, spray forming, nucleated casting, direct casting, etc.

Accordingly, there is a need to provide a more efficient and robust cold induction guide for a nucleated casting process. One aspect of the improved efficiency is the need for an electrical insulating material for the cold-walled induction-heated guide tube which electrically isolates the induction currents in the guide tube from leaking into the stream of liquid metal passing through the guide tube, but which does not contaminate the liquid metal being processed.

BRIEF DESCRIPTION OF THE INVENTION

The present invention relates to more structurally sound and efficient cold-walled induction heated guide and its application with respect to electroslag refining and nucleated casting.

According to a first aspect of the present invention, a cold-walled induction heated guide (CIG), adapted for a liquid metal pour, is provided. The CIG includes a medium frequency (MF) CIG operatively connected to a source of liquid metal and to a sink of a high frequency (HF) CIG through a central channel. The MF CIG includes a medium frequency electric power source (MFPS). Induction energy from the MFPS melts a skull on the source of liquid metal and melts a plug of solid metal within the central channel, maintaining a pool of liquid metal available to the high Frequency (HF) CIG. The CIG further includes the HF CIG operatively connected to the central channel of the MF CIG and to a liquid metal discharge path. The HF CIG includes a high frequency power supply (HFPS) and a central orifice. Induction energy from the HFPS melts a plug of solid metal within the central orifice when the HFPS is applied, thereby establishing a flow of liquid metal to the discharge path.

According to another aspect of the present invention, a system for nucleated casting of a refined liquid metal is provided. The system includes an electroslag refining (ESR) apparatus including a cold hearth. The ESR is adapted for supplying a liquid metal to a pouring apparatus. The pouring apparatus includes at least one series cold-walled induction heated guide (CIG). The CIG includes a plurality of copper finger segments surrounding a center channel adapted for receiving and discharging the liquid metal. An induction coil is adapted to supply induced power through the copper finger segments into the liquid metal. The inner wall of the copper finger segments in contact with the liquid metal includes an electrical insulating coating. The system further includes a nucleated casting apparatus adapted for receiving the discharged liquid metal from the pouring apparatus and casting the liquid metal.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein:

FIG. 2 illustrates a prior art cold-walled induction heated guide incorporating multiple sections of a copper finger with insulating material there between;

DETAILED DESCRIPTION OF THE INVENTION

Figure 1:
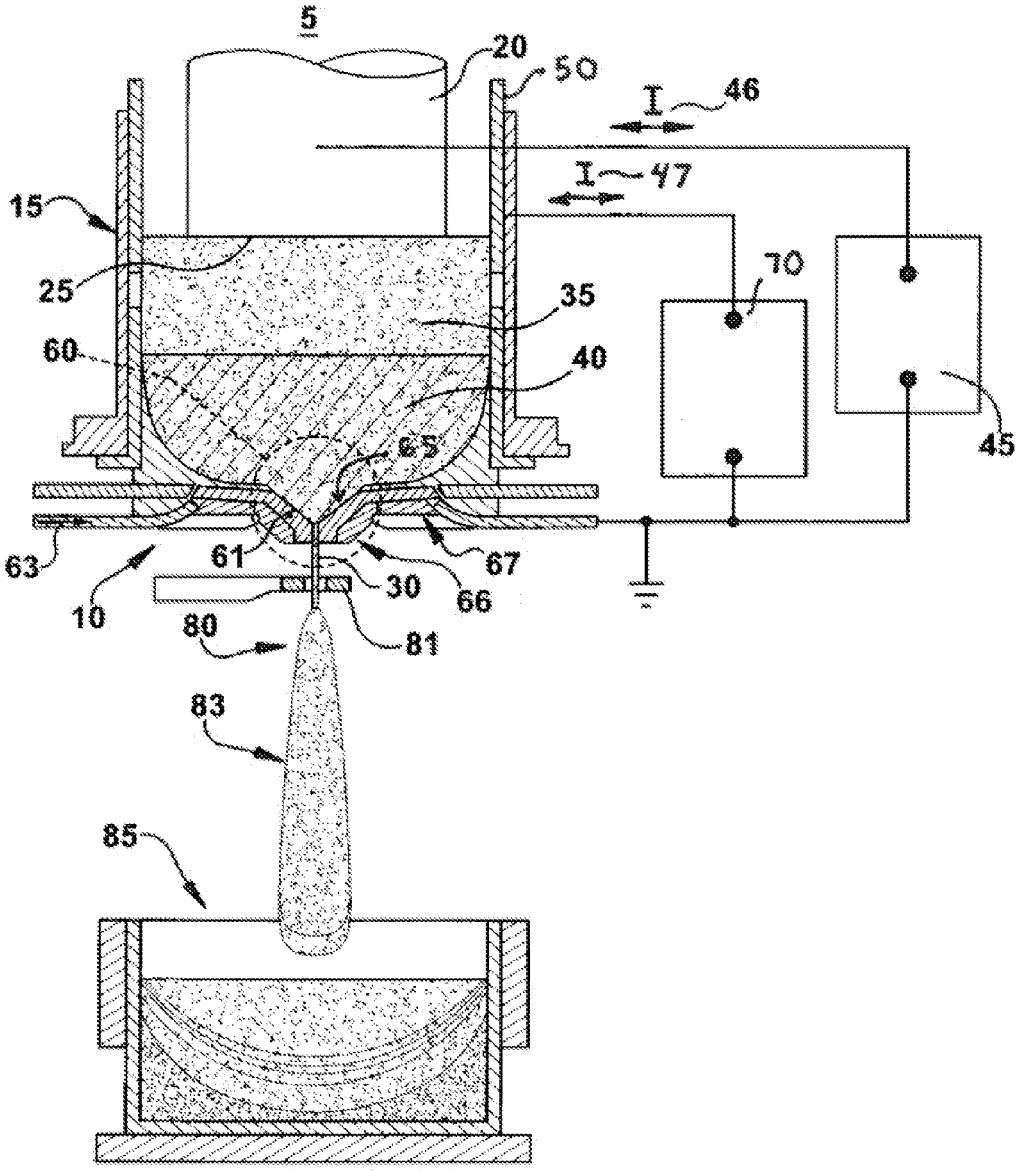
Fig. 1 (Prior Art)
FIG. 1 illustrates a prior art refining system for refining alloy metals in an electroslag refining furnace.
Figure 2:
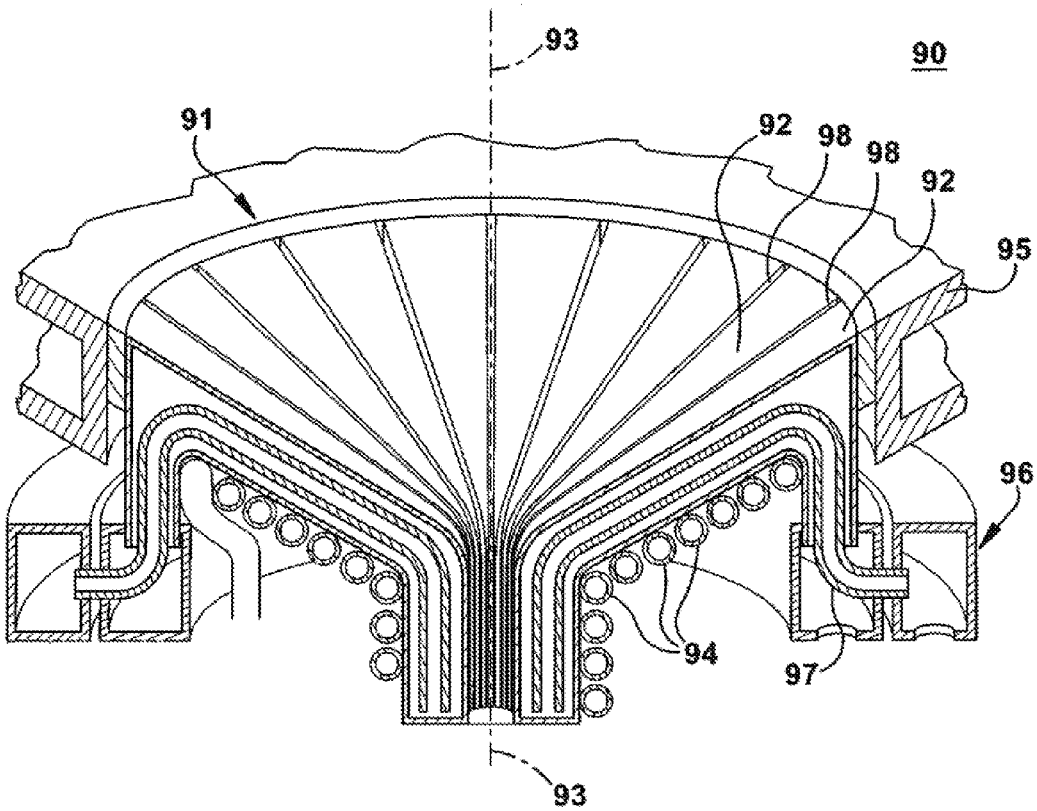
Fig. 2 (Prior Art)

The present invention has many advantages in providing a cold-walled induction heated guide (CIG), for electroslag refining (ESR) and nucleated casting, with mechanical simplicity, greater structural stability, higher efficiency and improved flow control.

The introduction of spray-formed metals into critical applications in the aircraft engine and power generation industries has been hampered by the possibility of erosion of oxide particles from a crucible lining, tundish, or pouring nozzle in conventional spray forming equipment. These oxide particles may become inclusions that limit low-cycle fatigue life of parts. The following embodiments of the present invention have many advantages, including a means of delivering ceramic-free alloys to a spray system while providing improved electrical coupling efficiency and thermal efficiency. The inventive CIG is facilitated by a new oven-brazed fabrication technique that helps resolve induction coil environmental isolation issues, corrects thermal strain tolerance problems, facilitates dual frequency induction designs, results in improved melt flow initiation, and facilitates disassembly without damage from the solidified melt. Use of soft magnetic materials has allowed improved efficiency, more compact design with limited cross-talk between medium and high frequency coils and facilitated environmental enclosure of the induction coils. The reliable use of ultra-thin, high-performance ceramic coatings has been provided, wherein these coatings permit a reduction in the number of segments needed in the CIG, yet do not interact chemically with the melt. The use of fewer segments improves mechanical stability of the segments and substantially reduces fabrication costs.

Faraday's law requires that the change in magnetic flux in the melt induce an emf (Equation 1). Evaluation of the integral around the surface of the copper fingers (encompassing the flux that is useful in heating the metal), shows that an electric field must exist that is proportional to the rate of change of flux in the melt. This indicates that there will be an electric field between fingers. Increasing the number of fingers lowers the field between the adjacent fingers.

$$\oint E \cdot dL = -\frac{d\Phi_b}{dt} \qquad \text{Equation 1}$$

Lorentz force levitation keeps at least a portion of the melt away from the fingers in traditional cold induction crucibles. However, cold induction guides operate with potential melt contact on all surfaces because local hydrostatic forces are larger than the Lorentz levitation forces. It is commonly assumed that a non-steady stochastic process occurs where the melt intermittently touches the copper fingers as it touches, freezes, and pulls away. If the field between two adjacent fingers in not large, only small currents are temporarily shunted through the melt, but high shunt current can cause the melt to fuse with the copper. If all gaps are shunted, secondary currents in the copper fingers become ineffective at inductively heating the melt. Large numbers of fingers cannot practically be implemented for nozzle-sized CIG geometries. Six to eight segments are the most that can be practically accommodated for 5-10 mm melt streams, requiring significant fabrication complexity and cost.

An eight-finger cold induction guide for bottom pouring from an ESR melter was previously built and tested as part of an ESR coupled clean melt delivery system for spray forming Although this device demonstrated proof of concept, it illustrated a number of design issues, four of which were significant: 1) the primary induction coil could not be isolated from the spray chamber leading to short circuiting of the primary coil and CIG fingers through powder infiltration because this compromised the system cleanliness. 2) the design of the device resulted in mechanical distortion and plastic deformation of the CIG from thermal strains; thus the finger gap and flow orifice diameter changed with each use; 3) the cost of fabrication was prohibitive; and 4) melt flow initiation was unreliable.

Direct calorimetry on a two sector CIG demonstrated that net CIG thermal efficiency increased by a factor of 2 when an electric insulating surface coating was applied to the CIG providing persuasive evidence that, for low number of fingers, short-circuiting can critically impair CIG performance. The introduction of standard ceramic insulators is regarded as unacceptable. The bulk ceramics act as a thermal insulator and the surface temperature of these materials approach the melt temperature where chemical attack, especially by titanium, is thermodynamically favorable. Furthermore, ceramics can liberate unacceptably large particles after chemical attack or as the result of thermal stress or shock. However, with a dielectric strength of about 20 V per micron, very thin films of alumina or tantala can provide the necessary electrical isolation, and thin films remain thermodynamically stable at copper surface temperatures. Sputtering and chemical vapor deposition (CVD) deposition can both yield coatings that are 100% dense and free of defects and have been proven durable in very aggressive environments such as aircraft engine turbine blades.

Copper is an electrically and thermally conductive material. Some applications require an electrically insulating layer on the surface of the copper to avoid conduction of electricity outside of the copper. An example of such an application is the CIG for pouring liquid metal. The induction heating of the CIG requires that the device be radially segmented. A surrounding induction coil induces a current in the CIG stream. It is important that electric current that flows through the copper is prevented from flowing into the liquid metal. If current does so, the efficiency of the unit is lost. An insulating layer is required. For this application, the requirements of the insulating layer were strenuous. It must sustain high thermal gradients and thermal shock, but also be robust and thin.

Direct application of existing coating technology, which was developed for superalloys and stainless steel substrates, to copper surfaces proved unsuccessful, and a bond coat was required. Nickel and titanium coating on copper were demonstrated as bond coats, and the thin coatings did not affect electromagnetic performance of the CIG. Sputtered nickel coatings of approximately 1 micron and cathodic arc coatings of titanium of several tens of microns were used. Sputtered alumina and CVD deposited tantala coatings on the bond coat were tested as insulating layers. Sputtered alumina on sputtered nickel is a well-developed technology and dominated our testing. However, sputtering is directional and requires precise surface preparation, posing difficulties in coating a CIG with curved surfaces. CVD deposition avoids these problems and was demonstrated to be compatible with brazed CIG components despite the high temperatures used during coating.

A thin electrical insulating coating for copper surfaces is provided. The coating is produced by first applying a 50 micron layer of titanium metal using a cathodic arc deposition process. This layer is polished and topped with a 5 to 10 micron layer of alumina, applied by sputtering. The resulting coating is robust in that it can take thermal shock without separating from the copper substrate.

The titanium layer forms a robust metallurgical bond with the copper. The sputtered alumina, which does not bond well to copper, is applied to the titanium layer, forming another robust layer. The resulting layer is thin, but electrically insulating. The coating of the present invention functions well when conventional insulators cannot take the harsh environment of this application. Unlike other conventional insulations such as plasma sprayed alumina, which is thick and friable, the insulating coating of the present invention is thin and adheres strongly to the applied titanium layer.

Bottom pouring from clean melting devices such as ESR electron beam, and plasma arc hearth melters, or induction heated cold crucibles is rarely considered because ceramic nozzle inserts would compromise the goal of a ceramic free product. The CIG can meet the need for regulated clean melt delivery from clean melt sources because it is an all-metal device. In the CIG, induction-heating coils surround several water-cooled copper fingers that contain the melt. Alternating current in the induction coil induces current in the fingers, which, in turn, induces a heating current in the melt. Water-cooling is used to remove the heat generated in both the coil and the fingers by the oscillating current.

Figure 3:
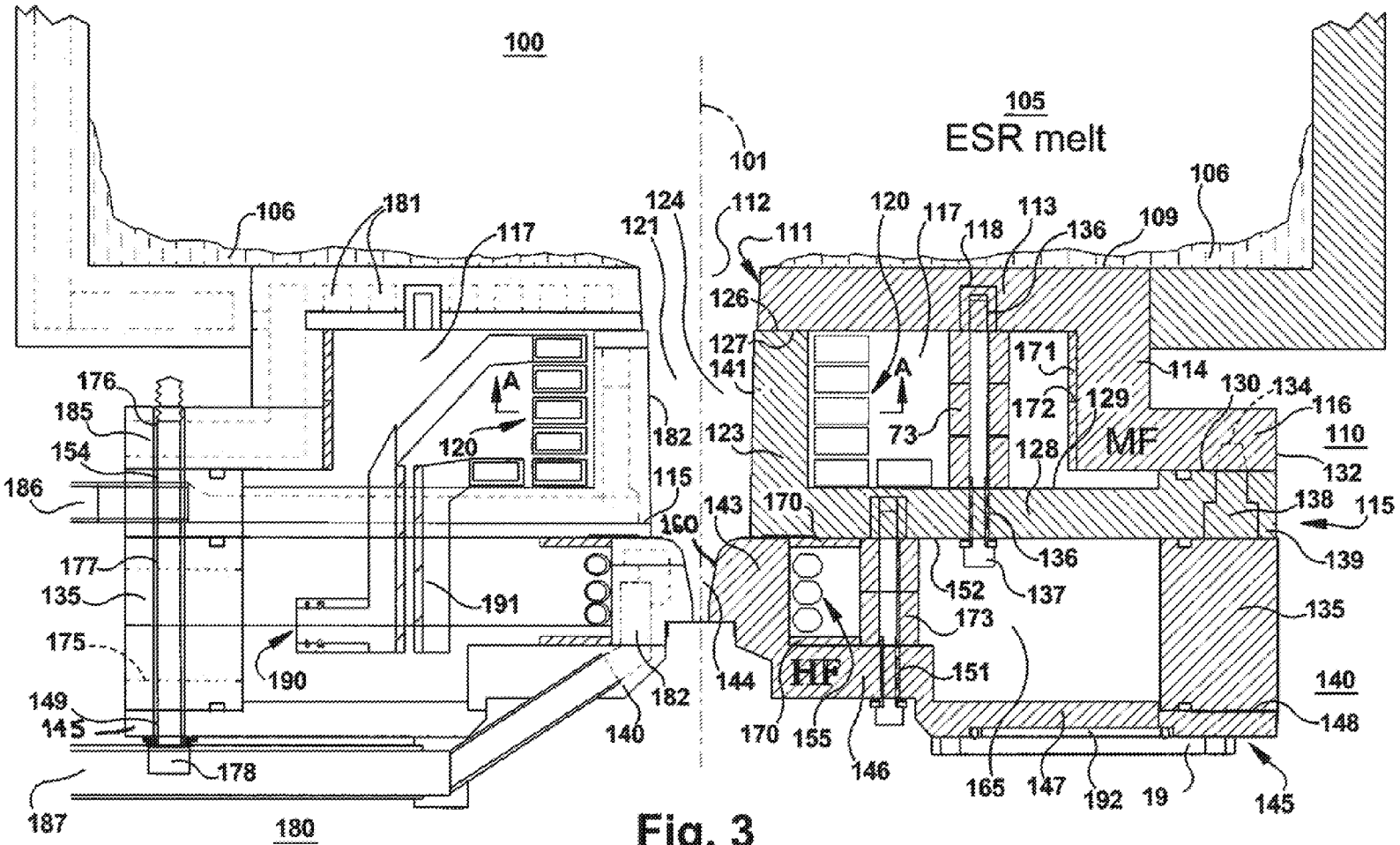
FIG. 3 illustrates a cutaway elevation view of an embodiment of the inventive CIG.
Figure 5:
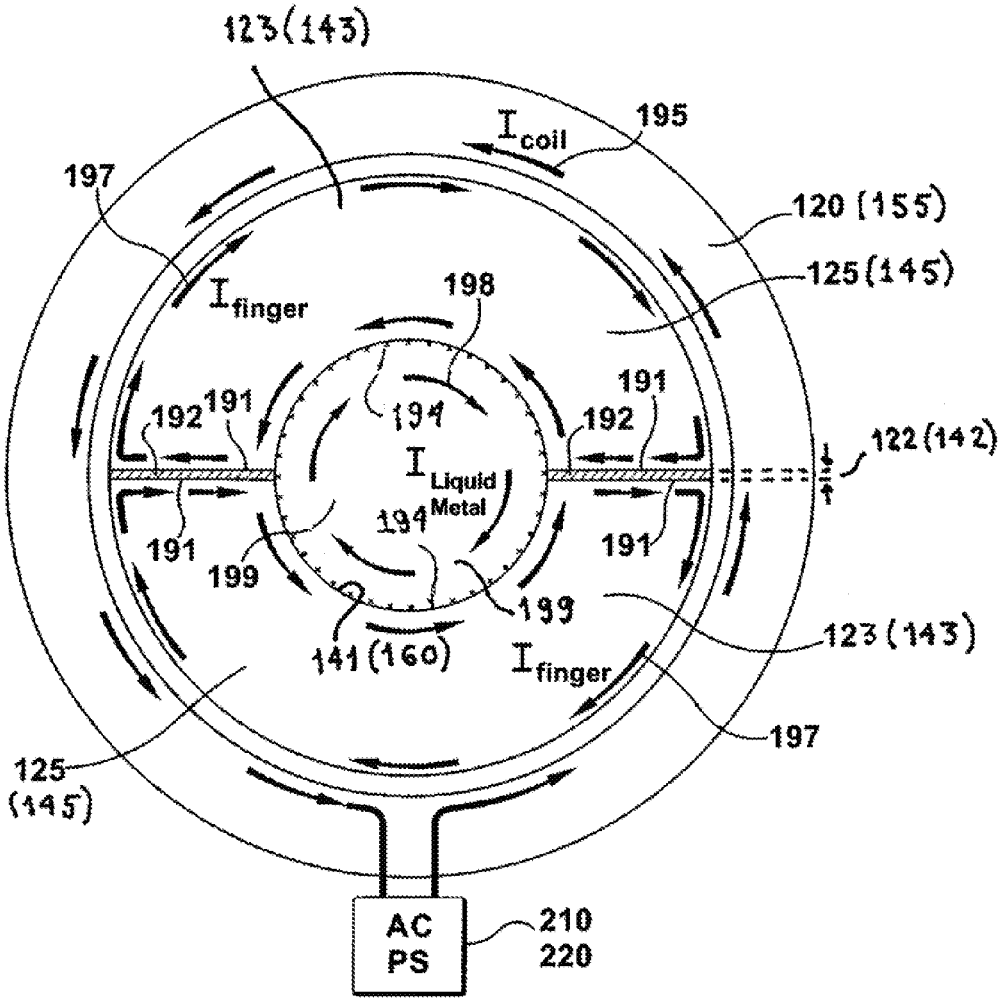
FIG. 5 illustrates a simplified representation for the transfer of energy from the flux coils of MF module to the liquid metal in the center hole at Section AA of FIG. 3.

The inventive CIG arrangement is shown in FIG. 3 and represents a significant departure from CIG designs of prior art such as Benz et al. (U.S. Pat. No. 5,160,532). The CIG system can be interpreted as three stacked regions, roughly cylindrical, of large, medium, and small diameters, with the largest on the top and the smallest on the bottom. A large top cylinder is the liquid metal source, an ESR furnace in this case. Surrounding the liquid metal is a water-cooled copper crucible and at the bottom, a plate with a central hole. The presence of the hole has only local affects on the flow streamlines, which are governed by thermally and electromagnetically driven convection in the melt pool. Below the central hole in the baseplate is the medium-diameter cylinder referred to as the Medium-Frequency CIG (MF CIG). The diameter of this region is chosen to guarantee convective coupling with the liquid metal above as the streamlines extend well into this region. The region is surrounded with water-cooled copper lingers and an induction coil, the frequency of which is chosen such that the skin depth of inductive coupling is approximately the radius of the region. The MF frequency may be desirably set to about 5 kHz. Below the MF CIG is a smaller diameter region referred to as the High-Frequency CIG (HF CIG). The diameter of this is chosen to match the desired liquid metal pour rate. Water-cooled copper fingers and an induction coil of the HF CIG also surround this small-diameter region. Again, the operating frequency may be desirably to give a skin depth equal to approximately the radius, about 110 kHz in this case. Power at the desired frequency is supplied external to the CIG from a MF power supply 210 and a HF power supply 220 (FIG. 5).

Figure 4:
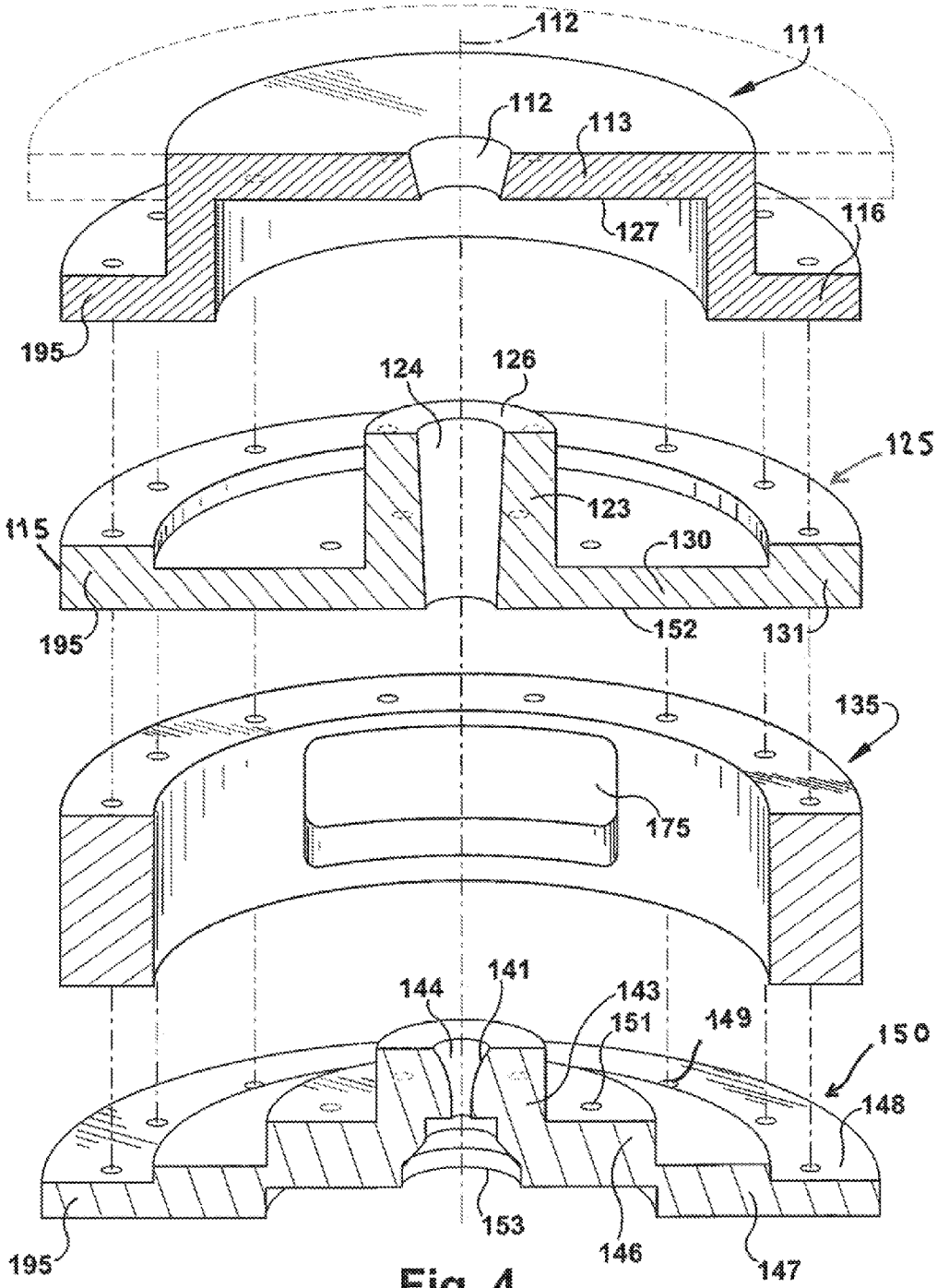
FIG. 4 illustrates an isometric exploded cutaway view for an embodiment of the inventive CIG.

FIG. 3 illustrates an embodiment of the inventive CIG 100 system for bottom pouring from an ESR melt supply. The right hand side of FIG. 3 shows the distinct electric and magnetic aspects of the CIG. The left hand side of FIG. 3 illustrates a cooling arrangement for the CIG. FIG. 4 illustrates an isometric exploded cutaway view for an embodiment of the inventive cold walled induction guide.

The CIG 100 includes a medium frequency CIG module 110 and a high frequency CIG module 140 attached to the bottom of the liquid metal source 105, which may be an ESR furnace. At the top is a baseplate 111 for the liquid metal source with a central hole 112. Below the baseplate, a moderate-diameter medium frequency (MF) CIG module 110 (5 kHz) is used to melt through the bottom skull 106 of the ESR 105 and provide superheat to the liquid metal. At the bottom is a high-frequency (11.0 kHz) control module 130 of narrow dimensions. The HF control module 130 needs to provide sufficient net heating to prevent freezing of the liquid metal in the flow control nozzle orifice 144.

The baseplate 111 of the MF module 110 may include an upper, generally circular, surface plate 113 with the center hole 112 and a vertical-oriented cylindrical section 114 that joins the upper surface plate 113 to a lower flanged surface 116. The baseplate 111 may engage with the copper finger 115 of the MF module to form an environmentally enclosed MF cavity 117 for protecting the MF induction coils 120 enclosed within. A top surface 109 of the surface plate 113 may form a bottom-center of the ESR and be in continuous contact with the liquid metal.

Early CIG designs provided cooling through the ESR base plate. However, thermal strain across the large baseplate caused movement of the CIG fingers. Various attempts to restrain or confine the fingers either compromised cleanliness with non-metallic parts, or destroyed CIG effectiveness by short-circuiting the CIG lingers or pirating primary coil current. Effective restraint of the fingers resulted in plastic yielding in the CIG with loss of dimensional tolerances both during and after a test. The CIG module uses an insert to the ESR (or other melt supply) base plate 111 that limits thermal strain. The strain in the baseplate affects only the baseplate tolerances. It is not transmitted to the fingers except as axial movement, which is accommodated by the CIG support plates. The remaining thermal strain in the CIG places the CIG fingers in compression, tending to close gaps during operation rather than opening them.

Earlier copper finger applications had suffered from inadequate support that allowed variation of the flux carrying arm of copper fingers in contact with the liquid metal and even caused significant changes in the size of the center hole, thereby resulting in significant and undesirable changes in the pour rate. For the inventive embodiment, the baseplate 111 and the MF copper fingers 115 may include bolt holes 136 and bolts 137, at an inner support location 118 just outboard from the MF induction coils 120. The baseplate 111 and copper fingers 115 may include bolt holes 134 and bolts 138 for engagement at outer support locations proximate to the outer radial ends of the members. The present inventive arrangement provides solid mechanical support for the MF copper finger 115 interface with the liquid metal.

The center hole 112 of the baseplate 111 may align axially with the center hole 121 formed by the copper fingers 115 of the MF module 110 along a central axis 101 of the CIG 100. The center hole 121 of the MF module 110 is formed by the inner surfaces 141 of the MF copper fingers 115. The inner surfaces 141 tapers slightly inward radially from top to bottom so as to prevent plugging during a liquid metal freeze and to allow easy extraction of the skull and disassembly between uses.

In a preferred arrangement for the MF module 110, two MF segments 125 are provided. An electrical insulation 195 is provided at small diametric gap 122 between the two MF segments 125. The diametric gap 122 divides the baseplate 111 and divides the MF copper fingers 115.

Each copper finger 115 of the MF segment 125 includes a raised central semi-cylinder 123, which acts as a flux-carrying arm. The central semi-cylinder 123 may include a central semi-hole 124. A top surface 126 of the semi-cylinder 123 engages with the underside 127 of the surface plate 113 of the baseplate 111. At the bottom side of each segment 125, a radial semi-circular plate 128 extends outward radially. The radial semicircular plate 128 includes an inner flange surface 129 and a raised outer flange surface 130. The raised semicircular flange surface 130 may include boltholes 138 at 131 for fastening in conjunction with the bolt holes 134 on undersurface 127 of the baseplate 111. The copper finger 115 may also include bolt holes 154 attaching with baseplate 111, with a spacer 135, 175 and with a copper finger 145 of the HF module 140 using bolt 178. The bolting holes for coupling the baseplate 111 to the copper finger 115 of the MF module 110 are interspersed circumferentially around the periphery of the CIG with the bolting holes for attaching the HF module 140, the spacer 135 and the MF module 110.

A preferred arrangement for a copper finger 145 of the HF module 140 may include two generally semicircular segments 150. Electrical insulation is provided at a small diametric gap 142 between the two segments 150. Each segment 150 includes a raised central cylinder 143 (flux-carrying arm). The central cylinder 143 includes a tapered central orifice 144 for flow control of the liquid metal to 153. The central cylinder 143 is disposed on a raised inner flange 146. An outer flange part 147 extends radially outward from the central cylinder 143. The outer flange part 147 includes a stepped surface 148 and boltholes 149 for mating with the spacer 135 and with the MF copper finger 115 and the baseplate 111 above. The raised inner flange 146 includes, near 19, bolt holes 151 for engagement with the undersurface 152 of the MF copper finger 115 above. Each bolt 178 extends through bolt holes 149, 177, 154 and 176 in the HF copper finger, the spacer, the MF copper finger and the baseplate, respectively. This bolting around the inner radial flange 146 and the outer radial flange 147 of each HF copper finger segment 150 attaches the HF module 140 to the MF module 110 and provides solid mechanical support for the HF segments 150 in contact with the liquid metal.

In combination, the copper finger 115 of the MF module 110 above, the spacer 135 and the HF copper finger 145 of the HF module 140 form an environmentally enclosed HF cavity 165 for protecting the HF induction coils 155 enclosed within. Prior art CIGs have suffered due to lack of protection for the induction coils and other components, particularly from the caustic environment of the atomized liquid metal spray in the spray systems positioned beneath the CIG. Isolating the induction coils from the final process chamber is critical for clean melt applications and mandatory for atomization processes where fine powder can cause short-circuiting of the induction coils or CIG fingers. However, the HF copper fingers 145 each include a bottom access port 192 that permits access to the HF cavity for final electrical connections. Surrounding the CIG induction coils with an all-metal housing intercepts stray flux that affects both CIG efficiency and mechanical design. A continuous metal surface that is thicker than the skin depth is a barrier to the penetration of flux, thus plates that separate the coils from the process chamber will shunt large currents when placed close to the primary coil, pirating useful currents on the inside surface of the induction coil. It is very desirable to separate the CIG mechanical support and water supply system from the bottom plate of the ESR melt supply system because these support components can pirate primary coil currents.

Within the cavity 117 of the MF module 110, a plurality of induction coils 120 is disposed closely around the flux carrying central cylinder 123 of the MF copper finger 115. As a result of the vertical orientation for center hole 121 of the MF module 110, the induction coils 120 and hence the flux in the flux carrying central cylinder 123 may be disposed in close proximity to the liquid metal in the central semi-hole 124, thereby promoting efficiency in the transfer of energy from the MF induction coils to the liquid metal and avoiding gross transfer of energy to the bulk of the liquid metal in the ESR 105. Since the ESR skull 106 is only a few mm thick, a reliable melt of the ESR skull can be accomplished with smaller entrance geometry to the MF module. Following initial melt-through from the ESR 105, electromagnetic stirring in the MF module 110 convectively transports MF module heat to the ESR, keeping a molten column of liquid above the CIG and through the ESR skull 106. This convected heat represents a reduction in net efficiency and is be minimized with the MF module geometry.

Similarly within the cavity 165 of the HF module 140, a plurality of induction coils 155 is disposed closely around the flux carrying central cylinder 143 of the HF copper finger 145. Again, the close coupling of the HF induction coils 155 with the liquid metal in the center orifice 144 of the HF module 140 promotes efficiency in the transfer of energy to the liquid metal therein.

FIG. 5 illustrates a simplified representation for the transfer of energy from the flux coils of the CIG modules to the liquid metal. The following describes energy transfer of the MF module. The reference numbers in parenthesis indicates the corresponding energy transfer for the HF module. Energy is transferred from MF module 110 (140) to the liquid metal in the center hole at Section AA of FIG. 3. A cutaway view shows MF coil 120 (155) surrounding the flux arms 123 (143) of the two copper finger segments 125 (145). Inner walls 124 (160) of the flux arms 123 (143) form center hole 121 (144) through which the liquid metal 199 flows. MF power supply 210 (220) establishes electrical current 195 in coils MF flux coil 120 (155) induces current flow 197 in flux arms 123 (143), which in turn induces current flow 198 in liquid metal 199, thereby effecting the energy transfer to the liquid metal. Radial surfaces 191 between opposing copper finger segments 125 (145) may be insulated 192. Further, the inner walls 141 (160) of the flux arms 123 (143) may be insulated 194 to promote induction efficiency between the flux arms 123 and the liquid metal 199. Inner surfaces 141 (160) of the flux arms 123 (143) MF module 110 (140) are exposed to high temperature liquid metal and advantageously employ the thin electrical insulating coating incorporating the bond layer of polished metal on the surface and an insulating layer of alumina or tantala. Energy transfer between the HF flux coils and the liquid metal is accomplished in a similar manner. Power is similarly supplied to the HF module 140 by HF power supply 220.

Referring again to FIG. 3, within the cavity 165 of the HF module, ferrite elements in proximity to the HF flux coils may further be provided to limit flux that otherwise may be shunted away from the flux carrying arm of the copper finger. The ferrites may be provided in the form of semi-cylindrical plate-shaped elements 170 above and below the HF induction coils 155. Within the cavity 117 of MF module 110, semi-cylindrical ferrite elements 171 may be provided on the vertical inner wall 172 of the baseplate 111 to limit flux loss for that module. For both the MF module 110 and HF module 140, ferrite sleeves 173 may further be provided around bolts 137, that otherwise may overheat and be catastrophically damaged by leakage flux from the MF and HF modules.

Ferrites enable a number of important design options. Foremost, ferrites above and below the primary coils allow flux loop closure without generating significant current in the support plates above and below the primary coil, preserving CIG efficiency while maintaining compact axial design. Ferrites outside the primary coils limit the radial extent of the field and shield uncooled structural elements such as bolts. Effective shielding outside the coil means that the induced field (Equation 1) outside the ferrites is zero and plates and support structures do not need to be split. This considerably simplifies mechanical design for seals, greatly stiffens support structures and aids in precision alignment.

Referring now to the left side of FIG. 3, a cooling arrangement 180 is provided to the MF module and HF module to remove heat created by the operation of the induction coils through electric and magnetic losses. A large part of the difficulty of the CIG design is the need to cool the MF segments and HF segments with water in a confined geometry. An oven braze procedure with silver-copper braze may be implemented to avoid space requirements, part distortion, and clean up machining that accompanies copper weld techniques. Oven braze construction permits cooling passages to be formed with simple short-depth boring and milling operations, thereby generating complicated internal cooling passage networks tailored to local heat load requirements. Water passages within 3 mm of melt surfaces may be reliably formed in this manner. Silver-copper braze does not impact thermal or electrical performance. Braze lines in direct contact with the liquid metal showed no sign of preferential attack or failure and braze lines on insulator coated surfaces accepted nickel sputter coats and both chemical vapor deposition (CVD) coats and sputter surface insulator coats without difficulty. After oven brazing of the CIG components, CIG sectors may be separated using wire electro-discharge machining.

The oven braze assembly allows creation of complicated flow channels to maximize heat transfer in critical areas and minimize water pressure drop in the large low energy density areas. The braze planes in the respective CIG and baseplate assemblies are illustrated. Some typical flow passage locations are shown with dashed lines, a combination of horizontal serpentine channels 181 in the support Plates and axial channels 182 in the CIG copper fingers. Oven brazing allows direct incorporation of stainless steel water supply tubes into the CIG assembly, providing some design flexibility to use thin wall supply tubing and welded flow transition elements. Stainless steel mechanical elements such as threaded inserts can be incorporated in the oven braze process as well if they are shielded from high magnetic fields.

A first cooling water inlet path 185 and outlet path (not shown) may provide cooling for the serpentine passages 181 for the MF module 110. A second cooling water inlet path 186 and outlet path (not shown) may provide cooling water to the axial passages 182 in the MF copper fingers 115 of the MF module 110. A third cooling path 187 is provided for the axial passages 182 in the HF copper fingers 145 of HF module 140. Cooling path 190 is shown for MF induction coils 120 of the MF module 110. A cooling path is provided for the HF induction coils 155 of the HF module 140 but not shown herein. Spacer 135 includes diametrically-opposed and radially-oriented access ports 175 for power 191 and cooling water 190 to the MF coils 120 and for power to the HF coils 155. The power 191 and the cooling water 190 for the MF coils pass through openings in the MF copper fingers segments 125 to gain access to the MF cavity 117.

A novel coil interface can allow the coils to be part of the CIG module assembly and the power bus-work is inserted after the CIG is in place in the ESR. The interface separates the coil cooling water from the electrical supply. The water connection is through slide-in seals and the electrical connection is through flat mating bus connections that are bolted once the insertion is complete. The flat bus supply may minimize stray fields so they can be run in a metal environmental enclosure without induction heating of that enclosure, and may allow instrumentation to reach the CIG without unacceptable electromagnetic interference.

Effective use of the ferrites 170, 171, 173 allows some CIG components to be uncooled. Most of the bottom support plate for the high frequency CIG is uncooled, as are all of the bolt flanges at the outside diameter. This greatly simplifies bolt placement, seal design, and coil connections.

The axial bolting system allows for substantial axial preload, minimizing any melt penetration between the HF and MF CIG systems. The CIG may be assembled, upside down on a bench, and then placed in service under the ESR furnace. Each CIG module in this structure is split into two segments (halves). This assembly minimizes damage on disassembly. As alloy skulls can penetrate into finger gaps and may shrink and preload the CIG on cooldown. In this design, the CIG can be pulled radially away from the skull to avoid scoring of the copper as would occur if the solidified skull is removed axially.

Operation of the entire device requires the insertion of a solid metal plug into the HF module orifice and, optionally, in the MF module region. In a startup, the ESR melt supply furnace is operated until liquid metal fills the MF module. At that time, the MF module power is applied to avoid freezing of the metal in the MF module region. When a stream is desired, power is applied to the HF module to melt the plug in the HF module orifice and start the metal stream. Power may be adjusted to influence the superheat of the metal stream. The MF module is used as an inlet conditioner to the HF module (orifice) nozzle. Initial melt-through of the ESR skull may fill the HF nozzle, however the MF module keeps the metal on top of the HF nozzle molten so the HF module is not required to melt through a skull, only to melt out its nozzle plug. Hydrostatic metal head from the MF module and ESR supply assure that a solid initial stream will overcome any surface tension and Lorentz levitation forces.

Testing of performance of the electrical insulation in contact with the liquid metal includes both coupon testing and testing with operating devices during pours. Coupon testing of flat disk coupons included thermal shock and sustained melt contact without electric fields. Flat disk copper coupons with coatings were subject to liquid melt drops. Sustained contact was obtained by placing an induction heated open-bottom ceramic tube, filled with molten IN718, on the water-cooled test coupon. High resistance was not maintained with I-micron coatings after sustained melt contact: No evidence of macroscopic failure of the coatings was observed, but pinhole (micron size) defects are believed to lead to low current short-circuiting. Five and ten micron alumina coatings were applied and similarly tested and showed no mechanical failure or electrical resistance failure. A typical scanning electron microscopy section of an alumina coating on copper shows no physical or chemical damage from coupon tests.

In operation testing subjects the insulating material to much higher average heat fluxes in the copper from the melt as well as surface-concentrated electrical dissipation lead to higher thermal strain and a hotter surface. Curved surfaces add to tension in coatings and the coatings are subject to electrical stress. Sputtered coatings were applied to CIG devices operating at about 5 kHz (250 kW primary coil) and 110 kHz (80 kW primary coil) with success. CIG coating evaluation included three elements; testing with bismuth as a low temperature substitute for Alloy 718 (which has comparable resistivity), visual and spot resistance measurements of coating resistance, and repeated 40 kg pours of alloy 718 and Alloy 304.

CIG gross efficiency is the fraction of the primary coil electrical power that heats the target metal, was measured using a differential change in CIG coil power to determine average skull heat transfer; small changes up and down in CIG bus power directly affect electric dissipation, but do not significantly change skull heat transfer. Net efficiency is based on the heat added to the melt in the CIG that raises the melt enthalpy of the metal that passes through the CIG; gross power minus losses to the CIG and convective losses to the melt supply. Net efficiency would be alloy dependent, as parasitic losses would be temperature and viscosity dependent.

Medium frequency CIG-Mechanical and thermal design limitations previously restricted the depth of the medium frequency CIG component, forcing inefficient placement of coil turns at larger radial locations. In geometries where the primary coil turns are placed against the ESR baseplate, primary coil power is pirated to the baseplate, and secondary induction heating takes place on the ESR skull. In this geometry, electromagnetic driven flows in the entrance region effectively transport most of the CIG supplied energy into the bulk ESR melt. Because of strong convection within the much larger volume ESR this energy does almost nothing to superheat the melt supply to the nozzle CIG.

Gross efficiency of a 4-fingered first generation MF CIG was measured at 20%. Gross efficiency of a 2-fingered second generation MF CIG with insulating coatings was 30 to 35% based both on calorimetry and integration of local flux measurements. A gross efficiency for this geometry was calculated by finite element analysis to be about 35%.

A further aspect of the inventive CIG is an asymmetrical nozzle design. Although circular cross-section nozzles are traditional, non-circular crossections have relatively little effect on the exit flow. Surface tension rapidly pulls the stream to a circular crosssection after exiting. For a coated CIG, this has significant advantages, since a semicircular orifice allows one of the CIG nozzle components to be flat. This makes directional coating processes much easier to use, and greatly simplifies the surface polishing and preparation for the coating. Extensive successful testing was conducted on semicircular orifices demonstrating excellent flow streams.

Figure 6:
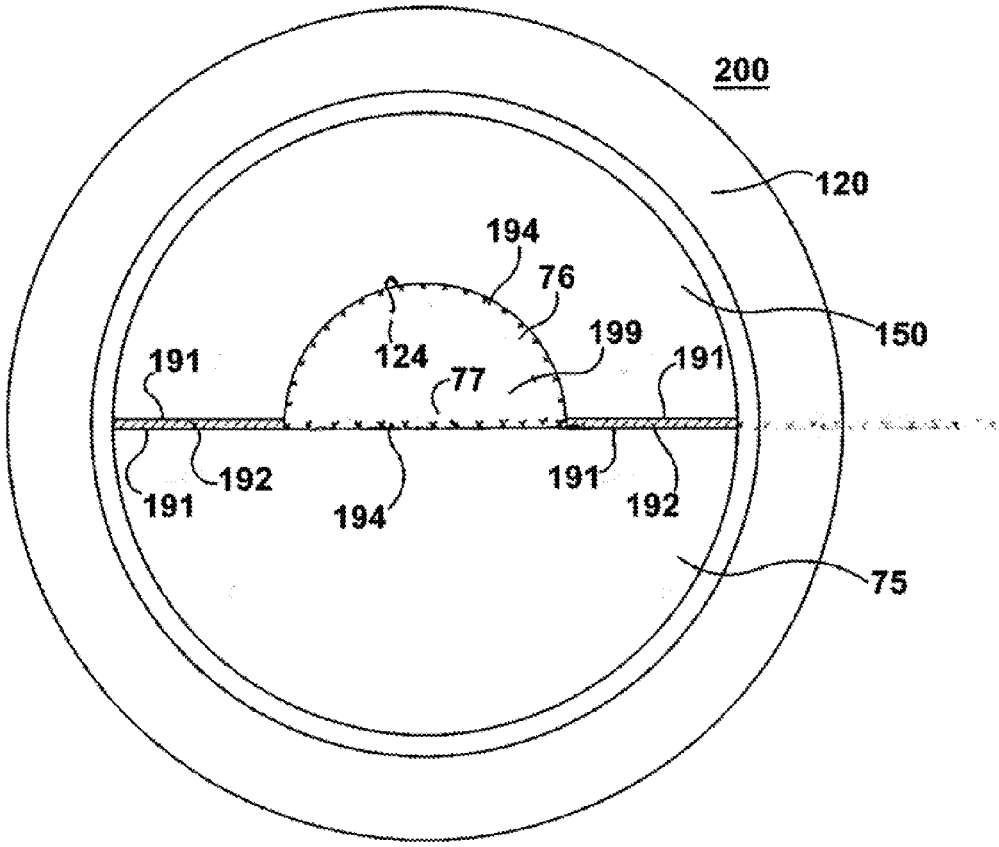
FIG. 6 illustrates a simplified cross-section of a HF CIG with a semicircular orifice.

FIG. 6 illustrates a simplified cross-section of a HF CIG with a semicircular orifice. The HF CIG 200 with the semicircular orifice 76 includes two HF copper finger segments 75, 150. The semicircular orifice 76 is formed within one HF copper finger segment 150. The second HF copper finger segment 75 has a plane surface in contact with the liquid metal 199. A first electrical insulating material 192 is provides to electrically isolate adjoining surfaces of the 191 of adjacent sections of the HF copper finger segments. A second electrical insulating material 194 is provided for surfaces exposed to high temperature liquid metal. The surfaces 77, 124 of the HF copper finger segments exposed to the liquid metal advantageously employ the thin electrical insulating coating incorporating the bond layer of polished metal on the surface and an insulating layer of alumina or tantala. The second insulating material is provided for corresponding surfaces (FIG. 5) of the MF copper finger segments in contact with the liquid metal 199.

The inventive cold-walled induction guide facilitates an efficient and reliable pouring system for ceramic-free delivery of superalloy metals from an ESR furnace. These design concepts include the use of ultra-thin insulating coatings, soft magnetic materials, and simplified oven-braze construction. Gross efficiencies up to 35% were demonstrated.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A cold-walled induction guide (CIG) adapted for a liquid metal pour, the CIG comprising:

a medium frequency (MF) CIG operatively connected to a source of liquid metal and to a sink of a high frequency (HF) CIG through a central channel, the MF CIG including a medium frequency electric power source (MFPS) wherein induction energy from the MFPS melts a skull on the source of liquid metal and melts a plug of solid metal within the central channel, maintaining a pool of liquid metal available to the high frequency (HF) CIG; and the HF CIG operatively connected to the central channel of the MF CIG and to a liquid metal discharge path, the HF CIG including a high frequency power supply (HFPS) and a central orifice, wherein induction energy from the HFPS melts a plug of solid metal within the central orifice when the HFPS is applied, thereby establishing a flow of liquid metal to the discharge path, further comprising a plurality of medium frequency (MF) induction coils being powered by the MFPS;

a plurality of MF copper fingers including generally annular segments arranged around the central channel of the MF CIG, and wherein the plurality of MF induction coils are wound around the plurality of MF copper finger segments and wherein inner walls of the MF copper fingers form the central channel;

an electrical insulating coating on the inner walls of the MF copper finger segments in contact with the liquid metal;

a plurality of high frequency (HF) induction coils being powered by the HFPS;

a plurality of HF copper fingers including generally annular segments arranged around the central orifice of the HF CIG, wherein the plurality of HF induction coils are wound closely around the plurality of HF copper finger segments and wherein inner walls of the HF copper finger segments form the central orifice; and an electrical insulating coating on the inner walls of the HF copper fingers segments in contact with the liquid metal; and a support arrangement for the MF CIG, the support arrangement including a baseplate formed as a bottom of the liquid metal source, wherein the plurality of MF copper finger segments are fixedly engaged to the baseplate at a plurality of outer circumferential locations and at a plurality of inner circumferential locations; and a support arrangement for the HF CIG, the support arrangement including an annular spacer separating the plurality of HF copper finger segments from the plurality of MF copper finger segments at an outer radial location, wherein the plurality of HF copper finger segments are fixedly engaged to an underside of the baseplate at a plurality of inner circumferential locations and the plurality of HF copper finger segments are fixedly engaged to the baseplate through the spacer and the plurality of MF copper finger segments.

2. The CIG according to claim 1, the electrical insulating coating comprising:

a bonding layer of one of titanium metal applied with a cathodic arc deposition process and polished; and a layer of one of alumina and tantala, applied by one of sputtering and chemical vapor deposition, on top of the bonding layer.

3. The electrical insulating layer according to claim 2, wherein a thickness of the bonding layer comprises about 50 micron and a thickness of the insulating layer comprises one of about 5 to 10 microns of alumina and about 1 to 10 microns of tantala.

4. The CIG according to claim 1, the central channel of the CIG comprising: a nominally vertical channel wherein the MF induction coils being wound closely around the annular segments of the MF copper fingers in close proximity to the central channel, promote efficient induction of power from the MF induction coils to the liquid metal within the central channel.

5. The CIG according to claim 1, further comprising:

a MF sealed cavity around the MF induction coils, the MF sealed cavity adapted to protecting the MF induction coils from an ambient gas and metal powder; and a HF sealed cavity around the HF induction coils, the HF sealed cavity adapted to protecting the HF induction coils from an ambient gas and metal powder.

6. The CIG according to claim 1, wherein the MF sealed cavity comprises a space between a baseplate forming an upper closure and the plurality of MF copper finger segments forming a lower closure; and the HF sealed cavity comprises a space between the MF copper finger segment forming an upper closure, the HF copper finger segments forming a lower closure and an annular spacer forming an outer circumferential closure.

7. The CIG according to claim 1, wherein the plurality of HF copper finger segments comprise two substantially semicircular segments and wherein the plurality of MF copper finger segments comprise two substantially semicircular segments.

8. The CIG according to claim 1, wherein the liquid metal source is an electroslag refining apparatus.

9. The CIG according to claim 1, wherein the discharge path for the liquid metal pour is a nucleated casting system.

10. The CIG according to claim 1, further comprising;

serpentine cooling channels in the baseplate; and axial cooling channels in the plurality of HF copper finger segments.

11. The CIG according to claim 1, further comprising oven-brazed closure planes on the serpentine cooling channels in the baseplate.

* * * * *